US005850745A

United States Patent [19]

Albright

[11] Patent Number: 5,850,745

[45] Date of Patent: Dec. 22, 1998

[54] KNITTED BRASSIERE BLANK HAVING INTEGRAL SEAMLESS ELASTICATED CONTOURS DEFINING BRA CUP BORDERS

[75] Inventor: David Albright, Rockingham, N.C.

[73] Assignee: The Russell Group, Ltd., Rockingham, N.C.

[21] Appl. No.: 834,196

[22] Filed: Apr. 15, 1997

Related U.S. Application Data

[63] Continuation-in-part of Ser. No. 811,894, Mar. 5, 1997, Pat. No. 5,855,123.

[51] Int. Cl.[6] ..... A41B 9/06

[52] U.S. Cl. ..... 66/176; 450/92; 2/73

[58] Field of Search ..... 450/65, 39, 40, 450/92; 66/171, 176; 2/73

[56] References Cited

U.S. PATENT DOCUMENTS

| | | | |
|---|---|---|---|
| D. 352,812 | 11/1994 | Van Laar . | |
| 2,352,866 | 7/1944 | Stach . | |
| 2,458,696 | 1/1949 | Elias . | |
| 2,498,487 | 2/1950 | Elias . | |
| 2,553,863 | 4/1951 | Myron . | |
| 3,425,246 | 2/1969 | Knohl | 66/176 |
| 3,500,665 | 3/1970 | Braxton et al. . | |
| 3,537,279 | 11/1970 | Epley . | |
| 3,772,899 | 11/1973 | Novi . | |
| 3,789,098 | 1/1974 | Cole et al. . | |
| 3,872,512 | 3/1975 | Ambrosiani | 2/73 |
| 3,985,004 | 10/1976 | Johnson et al. . | |
| 4,048,819 | 9/1977 | Johnson . | |
| 4,527,403 | 7/1985 | Fullbright et al. . | |
| 4,531,525 | 7/1985 | Richards . | |
| 4,663,946 | 5/1987 | Wright . | |
| 4,772,202 | 2/1988 | Imboden | 66/177 |
| 4,887,439 | 12/1989 | Tenconi | 66/51 |
| 5,103,656 | 4/1992 | Hanson | 66/185 |
| 5,181,278 | 1/1993 | Peleg et al. | 2/243 R |
| 5,210,882 | 5/1993 | Moretz et al. . | |
| 5,217,782 | 6/1993 | Moretz et al. . | |
| 5,249,320 | 10/1993 | Moretz et al. . | |
| 5,269,720 | 12/1993 | Moretz et al. . | |
| 5,291,617 | 3/1994 | Moretz et al. . | |
| 5,297,296 | 3/1994 | Moretz et al. . | |
| 5,306,536 | 4/1994 | Moretz et al. . | |
| 5,315,717 | 5/1994 | Moretz et al. . | |
| 5,319,807 | 6/1994 | Brier . | |
| 5,353,524 | 10/1994 | Brier . | |
| 5,377,507 | 1/1995 | Shima | 66/69 |
| 5,385,502 | 1/1995 | Moretz et al. . | |
| 5,392,467 | 2/1995 | Moretz et al. . | |
| 5,414,870 | 5/1995 | Moretz et al. . | |
| 5,435,014 | 7/1995 | Moretz et al. . | |
| 5,441,436 | 8/1995 | Moretz et al. . | |
| 5,471,683 | 12/1995 | Moretz et al. . | |
| 5,479,791 | 1/1996 | Osborne . | |
| 5,553,468 | 9/1996 | Osborne . | |
| 5,592,836 | 1/1997 | Schuster et al. | 66/176 |
| 5,605,060 | 2/1997 | Osborne | 450/92 |

OTHER PUBLICATIONS copy of applicant's copending 08/811,894 application, Mar. 4, 1997.

*Primary Examiner*—Andy Falik

*Attorney, Agent, or Firm*—Kennedy Covington Lobdell & Hickman, LLP

[57] ABSTRACT

Narrow contoured portions of a circularly knitted textile fabric may be elasticated by the selective insertion of elastic yarn segments in selected wales and courses defining the contoured area to be elasticated, preferably utilizing a circular knitting machine equipped with a computerized electronic needle selection system. In one application, a brassiere blank may be formed with curved elasticated annular contours to define borders of brassiere cups whereby a sports-type brassiere garment may be fabricated without a laborious cutting and sewing operation.

10 Claims, 4 Drawing Sheets

KNITTED BRASSIERE BLANK HAVING INTEGRAL SEAMLESS ELASTICATED CONTOURS DEFINING BRA CUP BORDERS

CROSS REFERENCE TO RELATED APPLICATION

This disclosure incorporates and has the priority of U.S. Provisional patent application Ser. No. 60/016,241, filed Apr. 19, 1996, entitled SPORT-TYPE BRA GARMENT WITH ELASTICIZED CUPS. This is also a continuation-in-part of copending U.S. patent application Ser. No. 08/811,894, filed Mar. 5, 1997, U.S. Pat. No. 5,855,123 entitled KNITTED TEXTILE FABRIC HAVING INTEGRAL SEAMLESS ELASTICATED CONTOURS, PANTY BLANK FORMED THEREOF, AND PROCESS OF FABRICATING A PANTY GARMENT THEREFROM pending.

BACKGROUND OF THE INVENTION

The present invention relates generally to ladies' brassieres and methods of fabrication thereof and, more particularly, to a brassiere blank formed of knitted fabric having integral seamless elasticated contours defining bra cup borders and to a brassiere made therefrom.

Traditionally, the fabrication of ladies' brassieres has been a highly labor-intensive and expensive process, typically involving the cutting and sewing together of multiple pieces of suitable fabric according to a predetermined pattern to provide a garment with appropriately shaped breast-conforming cups. Necessarily, such garments are relatively expensive due to the considerable amount of skilled workmanship required for the cutting and sewing operations. Heretofore, it has alternatively been proposed to utilize knitting processes in the fabrication of brassieres. Thus, U.S. Pat. No. 3,500,665 discloses the use of full-fashioning techniques in the manufacture of brassieres, while U.S. Pat. No. 3,537,279 discloses the fabrication of brassieres by a reciprocatory circular knitting process. U.S. Pat. Nos. 4,531,525; 5,479,791; and 5,553,468 disclose the manufacture of brassieres by differing methods of cutting and sewing a circularly knitted tubular brassiere blank. Such brassieres are commonly marketed as "sports" brassieres for use by women during athletic activities to provide enhanced support. U.S. Pat. Nos. 3,772,899 and 3,789,098 disclose the shaping of knitted fabric for use in brassieres by the after treatment of the knitted fabric.

SUMMARY OF THE INVENTION

It is an object of the present invention to improve so-called sports-type brassieres by providing for the novel formation of integral seamless elasticated annular contours in knitted textile fabrics, especially circularly knitted fabrics, thereby permitting the knitting of a novel brassiere blank wherein such integral seamless elasticated contours will define elasticated borders for breast cups in a brassiere fabricated therefrom.

Basically, the brassiere blank of the present invention comprises a knitted textile fabric formed of a body yarn formed in stitch loops aligned with one another in courses extending transversely of the fabric and in wales extending longitudinally of the fabric. According to the present invention, segments of an elastic yarn are formed with the body yarn in selected wales of selected courses at a frontal portion of the brassiere blank, with the elastic yarn segments causing the fabric of the body yarn to constrict at the selected wales and selected courses. The selected wales and courses are located in relation to one another to collectively define a pair of annular elasticated contours disposed side by side so as to form elasticated borders surrounding breast cups of the blank.

Preferably, the fabric of the present invention is formed by circular knitting, whereby the stitch loops of the body yarn extend in circumferential courses and are interlooped in axially aligned wales. The elastic yarn segments preferably are formed in stitch loops disposed in plated relation with the stitch loops of the body yarn. In order to cause the elasticated contour formed by the elastic yarn segments to extend both longitudinally and transversely relative to the body yarn fabric, the selected wales in which the elastic yarn segments are formed differ in at least some of the selected courses, preferably so as to cause the elasticated contour to extend arcuately in an annular curvature longitudinally across a plurality of adjacent courses of the body yarn and transversely across a plurality of adjacent wales of the body yarn.

A brassiere formed of the knitted blank of the present invention basically comprises a torso-encircling tube with a frontal portion to overlie the chest of a wearer and a dorsal portion to overlie the back of the wearer.

Various embodiments of knitted brassiere blanks and brassieres formed therefrom having these salient characteristics are contemplated. In one embodiment, the brassiere blank is circularly knitted as a seamlessly knitted fabric tube wherein the elasticated contours are disposed axially adjacent one another in the tube. Preferably, the tube will comprise two such blanks knitted annularly together. Utilizing such blank, the process of fabricating a brassiere garment is carried out by initially slitting the fabric tube axially between the adjoining blanks to separate each blank. Thereafter, the axial end edges of each blank are joined to one another, e.g., by sewing, to form a completed tubular brassiere garment. Alternatively, a single tubular brassiere blank of the described construction could be made as a seamless circularly knitted tube with the elasticated breast cup borders disposed annularly side by side. In such embodiment, the blank may be knitted or otherwise formed to include welt edges bordering the axial ends of the blank to form finished edges in the resultant brassiere garment.

The present invention preferably utilizes a circular knitting machine with a computerized electronic needle selection system such as manufactured under the brand name "Lonati" by Santoni SRL, an Italian knitting machine manufacturer located in Brescia, Italy. The electronic needle selection system of such machines conveniently enables greatly expanded needle selection and patterning capabilities and flexibility over conventional mechanical needle selecting devices, thereby facilitating the knitting of a fabric with a narrow contoured region of elastic yarn, e.g., a brassiere blank as described above with elasticated contours along the portion of the blank bordering the breast cup areas.

Preferably, the elasticated contour in each embodiment occupies only a few (e.g., twenty) wales of each fabric course, but to produce the contour necessary and desirable to form the desired annular contour of breast cups, the actual wales in which the elastic yarn is inserted shifts progressively from course to course to achieve the appropriate contour. The computerized needle selection capability of the "Lonati" machine is particularly advantageous to achieve this result. By use of such machine, the elastic yarn can be selectively inserted at a given feed of the machine to only the few needles necessary to receive the elastic yarn, and then during subsequent courses, different needles can be selected to receive the elastic yarn so as to produce a continuous yet contoured narrow annularly shaped elastic region. In each wale in which the elastic yarn appears, the elastic yarn is plated with the main body yarn of the blank.

DETAILED DESCRIPTION OF THE PREFERRED EMBODIMENTS

Figure 1A:
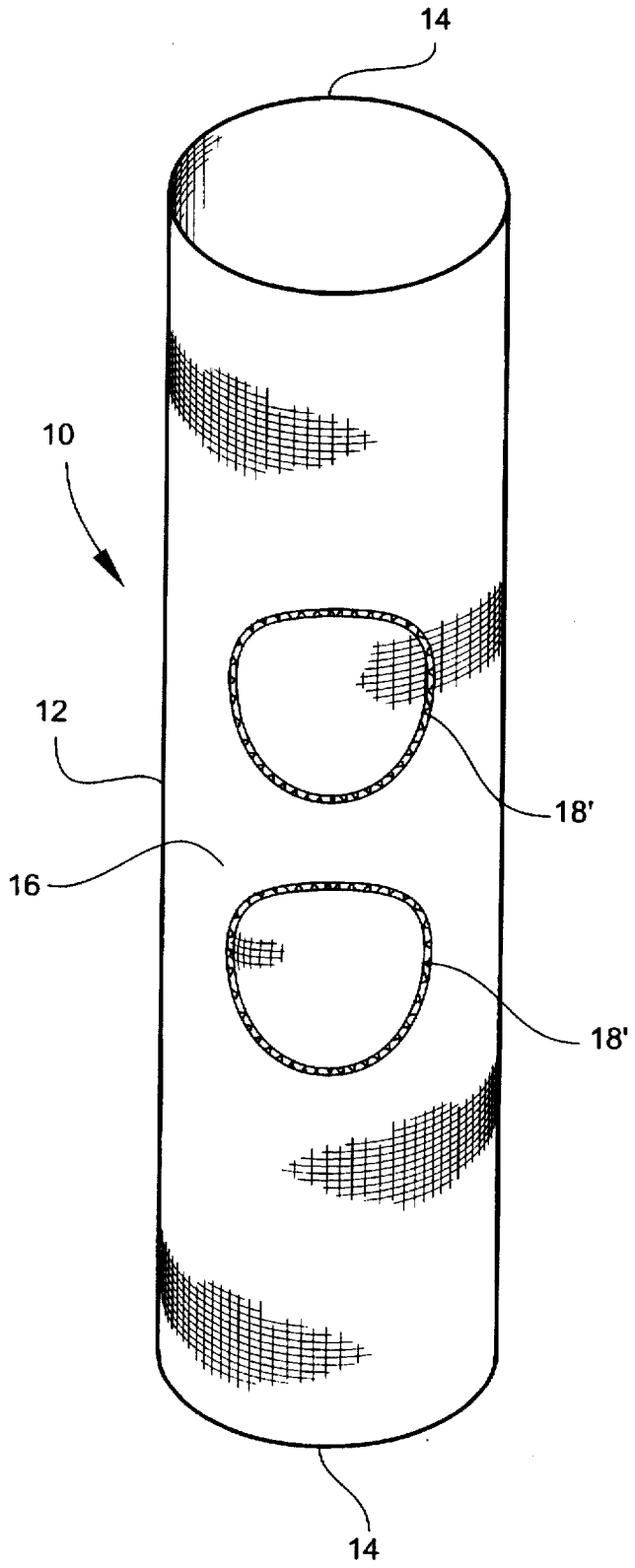
FIG. 1A is a perspective view of a brassiere blank in accordance with one embodiment of the present invention wherein the blank is circularly knitted as a seamless tube of fabric, the blank being depicted in FIG. 1 in the form as removed from the knitting machine prior to any subsequent processing.
Figure 1B:
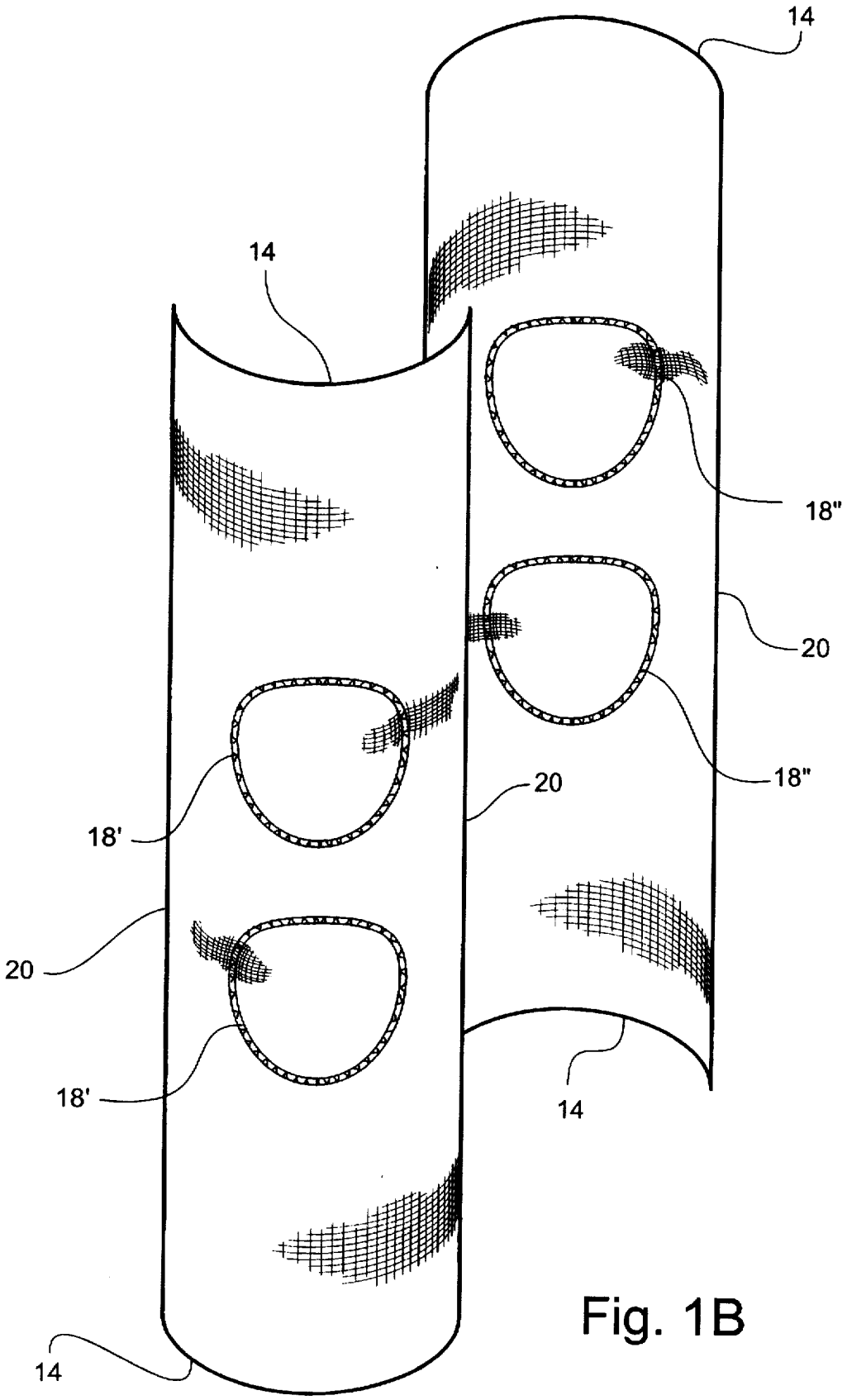
FIG. 1B is another perspective view of the blank of FIG. 1A after having been slit longitudinally to produce two individual brassiere blanks.
Figure 1C:
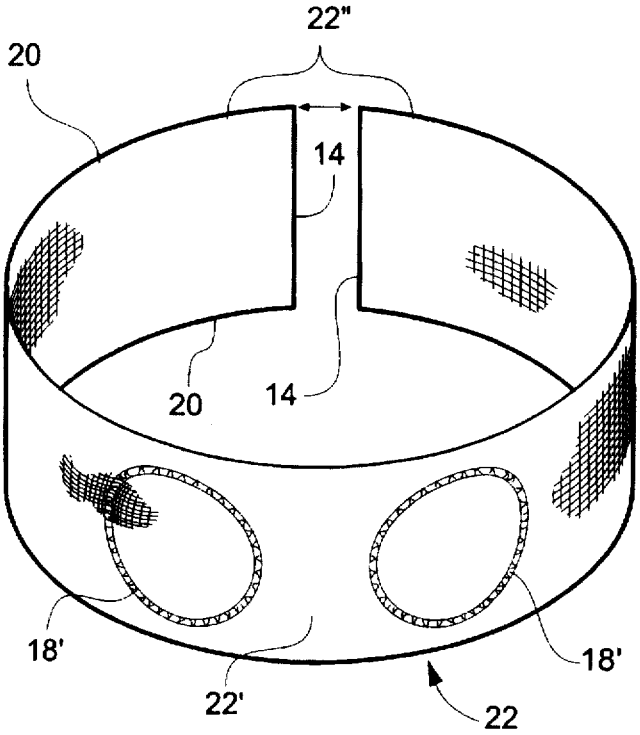
FIG. 1C is another perspective view depicting one of the slit fabric blanks of FIG. 1B in the process of being sewn into a brassiere garment.

Referring now to the accompanying drawings and initially to FIGS. 1A–1C, FIG. 1A is a perspective view basically showing one embodiment of a brassiere blank 10 according to the present invention as the blank comes off a hosiery-type small-diameter circular knitting machine such as the "Lonati" machine described above. Overall, the blank is formed as a seamless circularly knitted tube 12 having raw unfinished end edges 14 at each opposite axial end of the tube and an elongate lengthwise tubular knitted fabric body 16 extending axially between the end edges 14.

The embodiment shown in FIGS. 1A–1C contemplates the possibility of making two sports-type bras from a single tubular knitted blank by knitting two axially adjacent circular (or otherwise annularly shaped) elasticated regions 18' at one annular side of the tubular blank 10 and a corresponding pair of axially adjacent circular elasticated regions 18" (see FIG. 1B) at the opposite annular side. As depicted in FIG. 1B, the tubular knitted blank 10 would be slit axially at 20 along diametrically opposite sides of the tubular blank, after which each slit half of the blank would have its opposite end edges 14 sewn together to form the basic body of a brassiere garment 22, as depicted in FIG. 1C. Thus, the garment 22 is formed as a torso-encircling band or tube of fabric with the central axial extent of the original blank having the breast cups becoming the frontal portion 22' and the joined axial end portions becoming the dorsal portion 22". The raw cut edges 20 left by slitting would be finished in any appropriate way, e.g., by sewing to form a folded edge or to attach a finished tape or lace border to the raw edges, etc. In the knitting process, several needles may be utilized during each revolution of the knitting machine to form visible axial lines (not shown) lengthwise along the tube 12 to define guide lines along which the tube will be subsequently slit lengthwise.

The infinitely variable needle selection capabilities of the Lonati circular knitting machine (or any equivalent machine similarly having electronic programmable computer-controlled individual needle selection capabilities) enable differing variations in the particular knitted stitch construction of the fabric body 16 so as to knit the annular elastic contours 18',18". By way of example, but without limitation, one acceptable stitch pattern provides a four course repeat wherein the elastic yarn segments will be selectively inserted to only selected wales in only alternate courses of the knitted fabric over the course of knitting the central length of the fabric tube 12 over which the elasticated contours 18',18" extend, so as to thereby form the annular shape of the elasticated contours.

Figure 3:
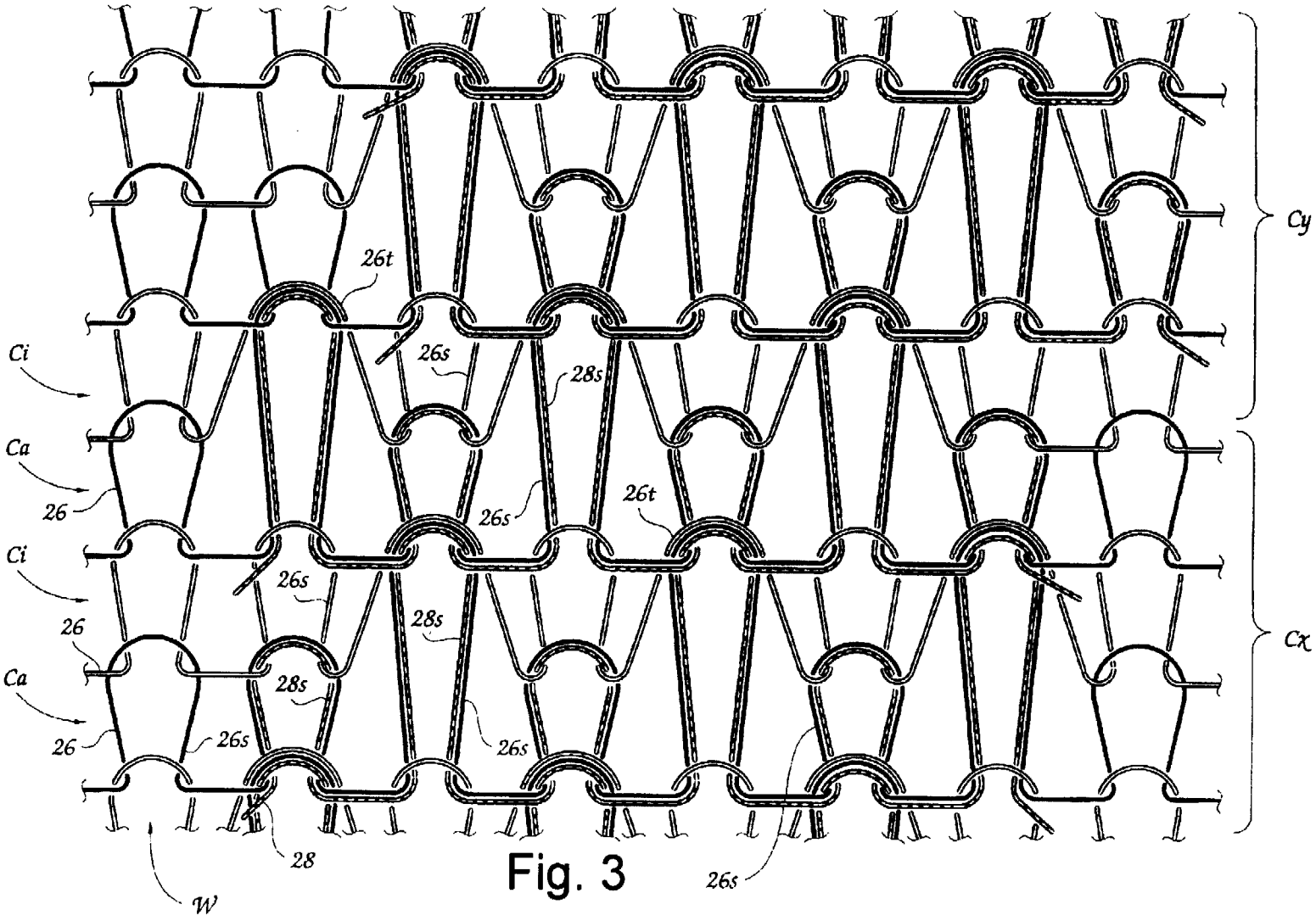
FIG. 3 is a diagrammatic elevational view representative of the knitted structure of the elasticated contours in the brassiere blanks of FIGS. 1A, 1B, 1C and 2.

Specifically, as depicted in FIG. 3, in knitting this region of the fabric body 16, alternate courses Ca will be of a plain jersey-knit construction in which a body yarn 26 is knit on every needle to appear in a full knitted stitch **26*s* in every fabric wale W. In such courses Ca, the elastic yarn 28 will be selectively inserted to only selected needles so as to appear in plain knitted stitches 28*s* in plated relation with the body yarn 26 in only such wales W of the fabric as necessary to incorporate the elastic yarn 28 in the annular elasticated contours 18',18". Thus, the needles selected to receive the plated elastic yarn 28 will change over the course of the knitting of the central lengthwise section of the fabric so as to form the elasticated contours 22 into the annular shape as indicated in FIG. 1. For example, in FIG. 3, the insertion of the elastic yarn 28 shifts one wale between courses Cx and Cy, although it will be understood that a greater walewise shift in the insertion of the elastic yarn 28 may be utilized depending upon the particular contour to be created. It should also be noted that, while as indicated above the walewise extent of the elasticated contours 22 wherein the elastic yarn 28 is inserted may span approximately twenty wales (or such other number of wales as may be necessary or desirable to accomplish a desired contour), the elastic yarn 28 is illustrated in FIG. 3 to span only six wales for sake of simplicity in the illustration of the knitted structure of the invention. During the knitting of this section of the fabric, the intervening courses Ci contain only the body yarn 26 knitted in plain jersey construction throughout each course Ci except in the elasticated contours 22 wherein the body yarn 26 is knitted in complete knitted stitches 26*s* on only alternating needles and formed in tuck stitches 26*t* on the intervening needles. From one intervening course Ci to the next intervening course Ci, the knitting and tucking of the body yarn 26** is reversed so as to be knitted on the intervening needles and tucked on the alternating needles.

Of course, the present invention is not restricted to this particular stitch pattern. Many various other stitch patterns could be utilized, provided that the elastic yarn 28 is selectively inserted into at least selected wales and selected courses so as to form the desired annular shape of the contoured regions 18',18" to be elasticated.

Figure 2:
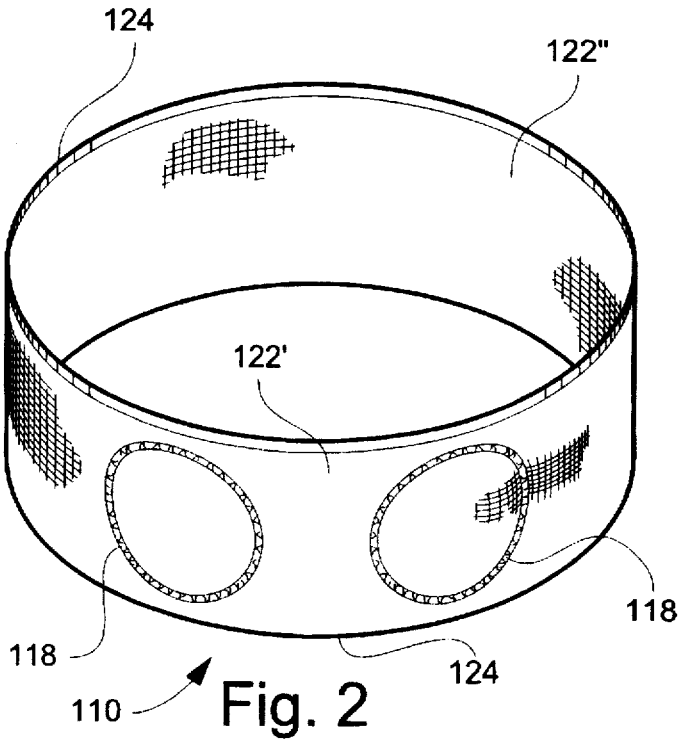
FIG. 2 is a perspective view of another brassiere blank according to a second embodiment of the present invention, also formed by circular knitting as a seamless tube of fabric.

In accordance with an alternate embodiment of the invention, a seamless brassiere garment can be fabricated from a blank 110, as illustrated in FIG. 2, wherein like reference characters indicate corresponding portions of the blank. Under this embodiment, the tubular blank 110 is knitted on the knitting machine in a diameter consistent with the desired chest size of the intended wearer of the brassiere garment to be fabricated. The top and bottom ends of the blank 110 are formed with turned welts 124 in a conventional fashion. The blank 110 thus comprises a frontal portion 122' occupying essentially one-half the circumferential extent of the tube 110 and a dorsal portion 122" occupying the other one-half of the tube's circumferential extent. At the frontal portion 122' of the tubular blank, a pair of elasticized annular contours 118 are formed by the same process described above but disposed annularly adjacent one another. Possibly, this embodiment would necessitate a somewhat larger diameter knitting machine than that used to knit the blank of FIGS. 1A–1C. Notably, no seam results anywhere on the finished garment.

A significant advantage of the two embodiments of the invention described above is that a brassiere garment, particularly sports-type brassieres, can be made very inexpensively with a minimum of labor expense. Taking advantage of the computerized needle selection capabilities of the Lonati machine, the computer program controlling the knitting operation can be quickly changed to alter any feature of the brassiere blank, e.g., the overall size of the blank, the size and the contour of the elasticized borders of the breast cups, etc.

It will therefore be readily understood by those persons Ski skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A knitted blank for manufacture of a brassiere comprising a frontal portion having a pair of arcuately curved elasticated annular contours knitted seamlessly in the frontal portion side by side one another for defining elasticated borders of breast cups, the blank being formed of a knitted textile fabric comprising a body yarn formed in stitch loops aligned with one another in transversely extending courses and longitudinally extending wales, the elasticated contours extending in an arcuate curvature longitudinally across a plurality of adjacent courses of the body yarn and transversely across a plurality of adjacent wales of the body yarn and comprising segments of an elastic yarn formed with the body yarn in selected stitch loops of the elasticated contours to elasticize the borders as an integral seamless element of the fabric.

2. A knitted blank according to claim 1, wherein the blank fabric is circularly knitted with the stitch loops extending in circumferential courses and interlooped in axially aligned wales.

3. A knitted blank according to claim 2, wherein the blank comprises a seamlessly knitted fabric tube having the bra cup borders disposed axially adjacent one another.

4. A knitted blank according to claim 2, wherein the blank comprises a seamlessly knitted fabric tube having the bra cup borders disposed annularly adjacent one another.

5. A knitted blank according to claim 4 and further comprising welt edges at the axial ends of the fabric tube.

6. A knitted textile fabric according to claim 1, wherein the elastic yarn segments include stitch loops disposed in plated relation with stitch loops of the body yarn.

7. A knifted blank according to claim 1, wherein the selected stitch loops of the elasticated contours are disposed in selected courses of the adjacent courses and in selected wales of the adjacent wales.

8. A knitted textile fabric according to claim 7, wherein the selected wales in some of the selected courses differ from the selected wales in other of the selected courses.

9. A knitted textile fabric according to claim 7, wherein the selected courses comprise alternating courses of the body yarn and the selected wales in each selected course comprise a selected number of successive wales.

10. A knitted textile fabric according to claim 9, wherein the adjacent courses comprise non-selected courses of the body yarn intervening the alternating courses, the body yarn in the intervening courses being formed in alternating stitch loops and tucks.

* * * * *